United States Patent [19]

Marquiss

[11] 4,385,210

[45] May 24, 1983

[54] ELECTRO-ACOUSTIC PLANAR TRANSDUCER

[75] Inventor: Stanley L. Marquiss, Carmichael, Calif.

[73] Assignee: Electro-Magnetic Corporation, Carmichael, Calif.

[21] Appl. No.: 188,757

[22] Filed: Sep. 19, 1980

[51] Int. Cl.[3] ..... H04R 7/18; H04R 11/02

[52] U.S. Cl. ..... 179/114 M; 179/115.5 ES; 179/115.5 PS; 179/116; 179/181 R; 181/150; 181/171

[58] Field of Search ..... 179/114 M, 115.5 ES, 179/115.5 DV, 115.5 PV, 115.5 PS, 116, 181 R, 181 F, 115.5 R; 181/171, 172

[56] References Cited

U.S. PATENT DOCUMENTS

| | | | |
|---|---|---|---|
| 2,077,170 | 4/1937 | Harrison | 179/115.5 R |
| 2,078,321 | 4/1937 | Freimann et al. | 179/1 E |
| 2,551,556 | 5/1951 | Brennan | 179/115.5 DV |
| 3,113,633 | 12/1963 | Eberhardt et al. | 179/1 GA |
| 3,672,462 | 6/1972 | Auer | 179/115.5 H |
| 3,674,946 | 7/1972 | Winey | 179/115.5 PV |
| 3,829,623 | 8/1974 | Willis et al. | 179/115.5 PV |
| 3,919,499 | 11/1975 | Winey | 179/115.5 PV |
| 4,010,334 | 3/1977 | Demeter | 179/114 M |
| 4,112,256 | 9/1978 | Carlsson | 179/1 GA |
| 4,220,832 | 9/1980 | Nagel | 179/115.5 DV |
| 4,256,198 | 3/1981 | Kawakami et al. | 181/141 |

FOREIGN PATENT DOCUMENTS

| | | | |
|---|---|---|---|
| 902015 | 1/1954 | Fed. Rep. of Germany | 179/115.5 H |
| 2733580 | 2/1979 | Fed. Rep. of Germany | 179/114 M |
| 55-46673 | 4/1980 | Japan | 179/115.5 PS |
| 55-46674 | 4/1980 | Japan | 179/115.5 PS |
| 55-77298 | 6/1980 | Japan | 179/115.5 PS |

OTHER PUBLICATIONS

Publication Unknown, Date Unknown, "Panel Speaker Designs" Grieg & Schoengold, pp. 36–38 (Radio-Electronics).

*Primary Examiner*—George G. Stellar
*Attorney, Agent, or Firm*—Lothrop & West

[57] ABSTRACT

An electro-acoustic transducer using thin, lightweight, planar diaphragms driven by strategically located, coil-driven, high-energy, permanent magnets. A framework maintains the diaphragms in substantially co-planar relationship a predetermined distance from and parallel to a rear support wall. The diaphragms include at least one hinged woofer diaphragm and a foam-supported tweeter diaphragm. The small, high energy movable permanent magnets are attached to the rear surface of each movable diaphragm. Cooperating with each movable magnet is a respective, stationary electromagnetic coil with a crossover network directing the incoming signal to the appropriate coils, thereby placing the magnets and attached diaphragms into cooperating fore and aft motion. The frontal acoustical waves produced by each woofer constructively interfere to augment low frequency response. The tweeter construction provides wide frontal dispersion of high frequency acoustical waves. Woofer backwaves are attenuated before emerging along the rear support wall and the tweeter backwave is vented into a rear isolative chamber.

12 Claims, 10 Drawing Figures

ELECTRO-ACOUSTIC PLANAR TRANSDUCER

BACKGROUND OF THE INVENTION

1. Field of the Invention

The invention relates generally to the field of electro-acoustic transducers, or loudspeakers, using planar elements, or diaphragms.

More specifically, the invention relates to a thin loudspeaker system using planar diaphragms fashioned from rigid, lightweight panels. The particular configuration allows the speaker system to be mounted directly upon a support wall, or the like, in such a way that the loudspeaker system and the wall cooperate in an acoustically advantageous manner.

The invention also relates to an improved combined stationary coil and moving magnet electromagnetic drive assembly for the lighweight planar diaphragms, utilizing state of the art magnetic material having an extremely high energy product.

2. Description of the Prior Art

From the standpoint of a design ideal, the mechanical resistance, or impedance, of the air impinging upon the diaphragm of an electro-acoustic transducer should form an appreciable portion of the total electrical impedance which the transducer presents to the electrical driving energy source. This ideal electro-acoustic transducer, then, would effect an efficient couple, or match, between the electrical energy source and the mechanical load which the air present to the acoustical wave producing diaphragm. Additionally, with a high coefficient of acoustical coupling, the performance of the transducer would become highly predictable. In other words, with the surrounding air mass comprising a substantial, stable, and frequency-independent load for the transducer, the vagaries in acoustical response introduced by transducer enclosures and spatial placement can be minimized.

Since air is a light and subtle medium, an acoustical diaphragm must engage a large number of air molecules to produce a reasonable sound level. It is apparent, further, that a planar diaphragm, which by its nature is capable of presenting a large surface area to the surrounding air, should be an efficient means for coupling to, and placing into motion, a large mass of air. Owing to its high coefficient of acoustical coupling, a large planar diaphragm need not make large and rapid excursions to create a substantial sound level. Making limited and relatively slow excursions, a planar diaphragm is able to avoid the acoustical incongruities characteristic of a conventional cone-shaped diaphragm.

Restricted by constructional considerations to a relatively small maximum size, a cone-shaped loudspeaker must make large and rapid axial excursions to produce an acceptable level of sound pressure. That is to say, since the cone diaphragm cannot directly couple a large mass of air, it must compensate by quickly displacing what air it does engage a considerable distance to reproduce sound at satisfactory levels.

As a result of this basic requirement of a large cone excursion, a number of well known electrical and mechanical problems arise with a conventional moving coil, cone-shaped loudspeaker. The speaker's moving coil, attached directly to the cone, creates a motion-related inductive reactance, or back EMF, which is directly related to the heightened distance and speed through which the coil must move each cycle. This dynamic back EMF, in turn, causes peaks and dips in speaker response which vary with overall speaker amplitude.

When the moving coil exerts translational force to the peak portion of the suspended cone diaphragm, irregularities in the cone's mechanical response occur. Unable to respond to the applied force in linear fashion, the wobbling cone creates skewed wave fronts which interfere to the detriment of a smooth acoustical response.

A more subtle acoustic deficiency is inherent with the large diaphragm excursions characteristic of cone speakers. To maintain compliance with a given input waveform, the cone diaphragm must also travel faster than a planar diaphragm, since the former is being displaced a greater distance. At high volume levels, when excursions are the greatest, the cone moves so fast that the displaced air is highly compressed, causing a veiled, but still perceptable aural distortion, or breakup. The planar diaphragm with its less drastic movement, is free from this compressive distortion of the air.

While the planar diaphragm has the potential to overcome many of the inherent deficiencies of the cone shaped diaphragm, as previously indicated, the prior art relating to planar loudspeakers has not solved several remaining problems, as will now be explained.

Planar diaphragms, as all other diaphragms, physically oscillate in response to the input waveform, producing both a front and a rear wavefront. If the rear of a planar diaphragm loudspeaker system is placed near a wall, or other reflective surface, the backwave will be returned to interfere acoustically with the front wave. This acoustic interference will produce amplitude peaks and valleys at varying frequencies, making linear response of the system impossible. Additionally, a portion of the reflected backwave will impinge upon the radiating diaphragm itself, resulting in unwanted mechanical and electrical reactances. While these adverse effects can be lessened, to some extent, by placing the system some distance from the rear wall, such placement is physically impractical or esthetically undesirable in many installations.

Most of the loudspeakers having planar diaphragms use diaphragm driving assemblies which are inherently mismatched to the source. The electrostatic driver, for instance, requires a step-up transformer having a large inductive reactance component. This substantial inductive reactance imposes both a load problem for the driving source and a limitation upon the high frequency response of the system. Thus, within the known prior art associated with planar diaphragm loudspeakers, considerable room for improvement exists both in the treatment of the "backwave problem" and in the electro-mechanical means for driving the planar diaphragm.

SUMMARY OF THE INVENTION

The present invention turns away from the conventional approach to creating an acoustical wave using a planar diaphragm. While most loudspeakers using planar diaphragm construction use a single wave-producing diaphragm, the use of a segmented, or divided, planar diaphragm arrangement is not unknown. A large planar diaphragm is commonly used for reproducing the low frequencies while a more mobile, small planar diaphragm generates the high frequencies.

However, although segmented planar diaphragms per se are not new, the particular configuration disclosed herein accomplishes considerably more than merely reproducing low and high frequency acoustical wave forms. The segmented planar diaphragm of the present design allows the entire system to be mounted directly upon a wall or other planar support surface. Portions of the backwaves of the woofer diaphragms are strategically vented through lateral slots or apertures between the loudspeaker's main frame and the wall, turning an acoustical problem into an acoustical asset. This is to say, the loudspeaker and the rear positioned wall cooperate to acoustical advantage.

As a further result of the woofer diaphragm configuration, the low frequency front waves interfere constructively to produce an augmented, in phase, wavefront. The placement and construction of the tweeter diaphragm further provide excellent high frequency dispersement while minimizing unwanted interaction with low frequency waves.

The woofer and tweeter planar diaphragm combination is housed within an extremely thin framework. Thus, the configuration allows a slender loudspeaker construction which is attractive and unobtrusive when placed upon a support wall.

The means for driving the lightweight planar diaphragms uses rare earth, samarium cobalt, moving magnets, rather than a coventional moving coil design. Having an extremely high energy product, the moving magnets can be reduced in size and weight, thereby decreasing the dynamic mass and inertia of the drive system compared with a moving coil type of drive system.

The plurality of stationary driving coils for each diaphragm is connected in parallel, presenting a resultant low impedance, low reactance load to the driving source. As a consequence, the drive system for the diaphragms is ideally suited for a maximum transfer of energy over a wide frequency spectrum, in contrast to known prior art.

Thus it is an object of the present invention to provide an improved electro-acoustic transducer using a segmented, or divided, planar diaphragm construction.

It is another object to provide a thin, planar loudspeaker system which is mounted directly upon and cooperates acoustically with a wall or other supportive planar surface.

It is yet another object to provide an improved electro-magnetic means for driving planar diaphragm elements using a plurality of high energy product magnets in conjunction with respective, stationary magnetic coils.

It is still a further object of the invention to provide a generally improved electro-acoustic planar transducer.

These and other objects of the present invention are illustrated in the accompanying drawings and described in the detailed description of the preferred embodiments to follow.

DETAILED DESCRIPTION OF THE PREFERRED EMBODIMENTS

Figure 1:
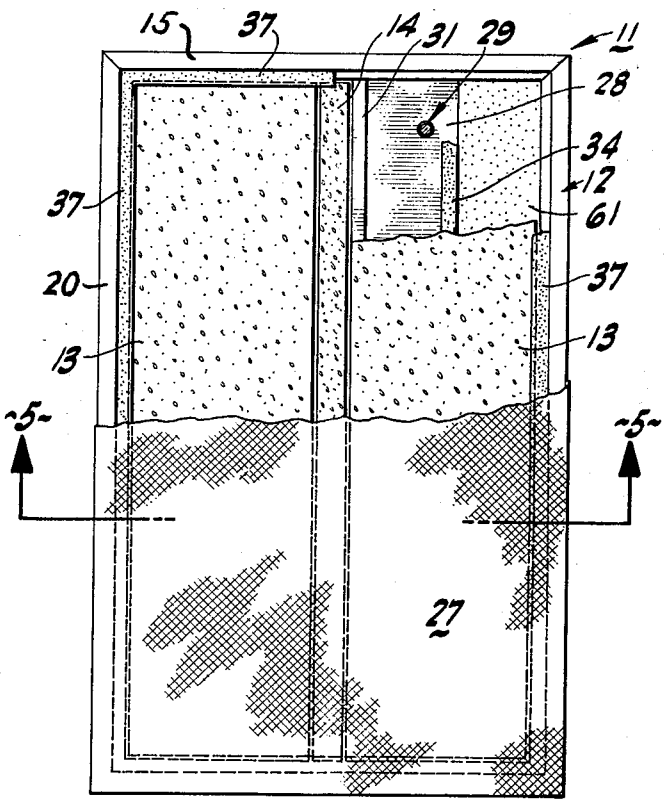
FIG. 1 is a front elevational view of one form of the transducer of the invention, with a portion of the grill cloth broken away to reveal the segmented planar diaphragm construction having a vertical central tweeter straddled by a pair of vertical woofers, and with a portion of the woofer diaphragm broken away to reveal interior structural details.
Figure 3:
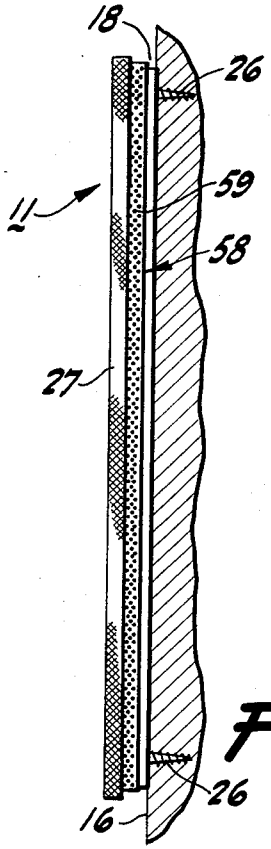
FIG. 3 is an elevational view of one side, showing the invention mounted upon a wall or other supportive planar surface.
Figure 4:
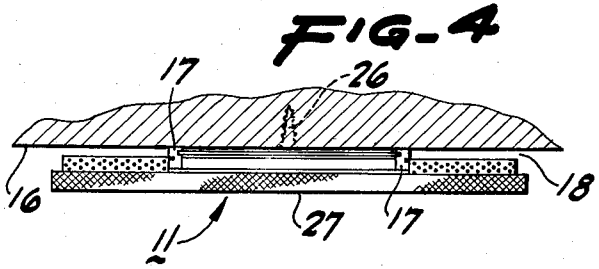
FIG. 4 is a top plan view thereof.
Figure 2:
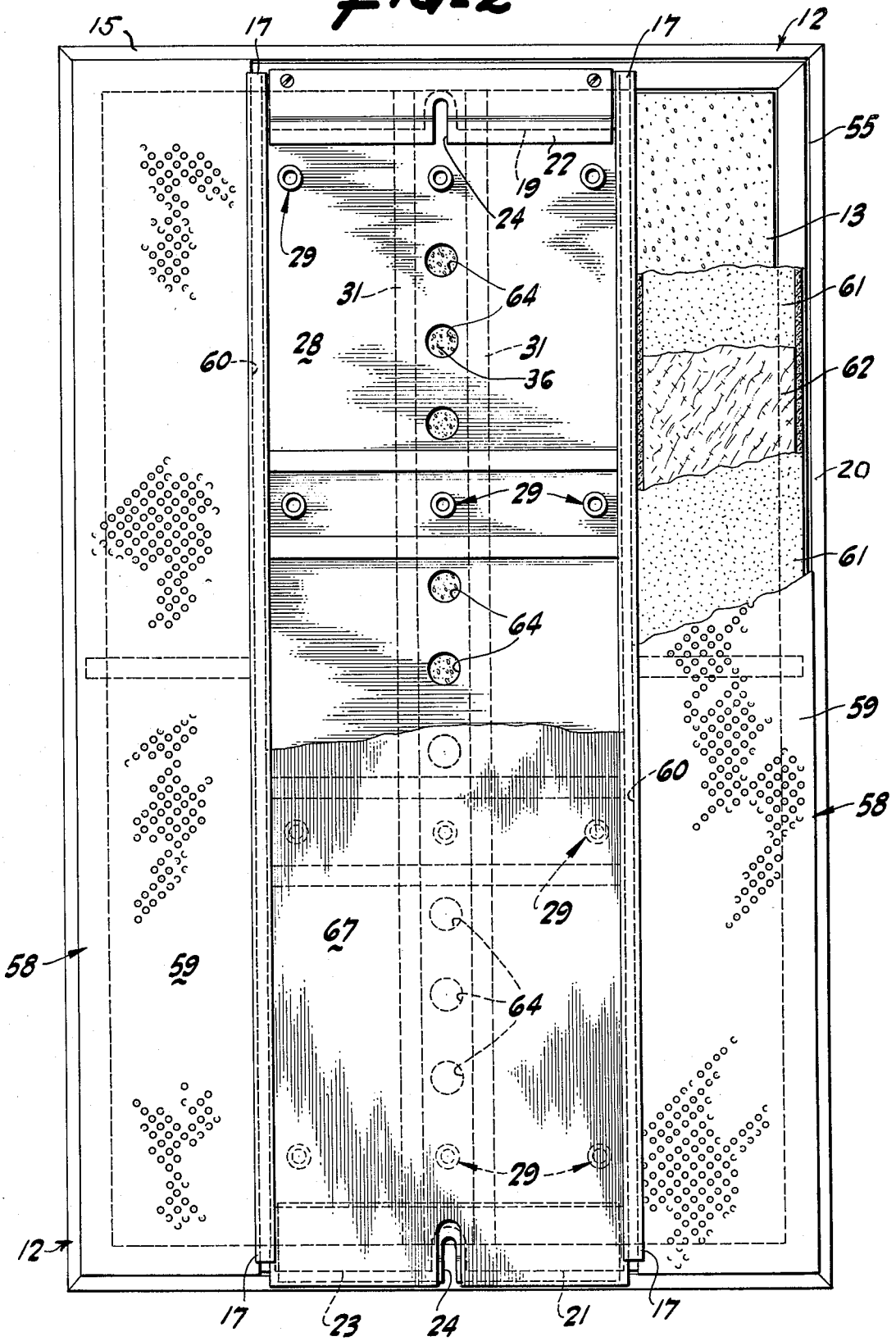
FIG. 2 is a rear elevational view thereof, to an enlarged scale, with the upper portion of one of the lateral perforated cages broken away to show the underlying sound alternating cell formed of layers of sound absorptive material, and with portions of the transparent rear plate and the front mounting plate broken away to reveal a portion of the woofer diaphragm located on the front, or outer, portion of the device.

With particular reference to FIGS. 1–7 of the drawing, a preferred embodiment of the invention 11 generally comprises a rectangular, picture-like frame 12 encompassing two planar woofer diaphragms 13 straddling a single planar tweeter diaphragm 14. The frame 12 includes a pair of horizontal rails 15 and a pair of vertical side pieces 20 and is built to maintain the two woofer diaphragms 13 and the tweeter diaphragm 14 in co-planar relation a predetermined distance from and parallel to a room wall 16, or other planar surface. FIGS. 2, 3 and 4 best show a pair of vertically oriented ribs 17, extending between and attached to the top and bottom rails 15 and serving to space the rear face of the frame 12 approximately 1" from the wall 16. A lateral slot 18, or aperture, is thereby defined, extending around the periphery of the inner, or after, side of the frame 12. The acoustic function of the slot 18 will subsequently be explained in detail.

The frame 12 also includes a horizontal upper brace 19 and a horizontal lower brace 21 extending between and attached to the ribs 17. Secured, in turn, to the upper brace 19 and the lower brace 21 are upper and lower resilient metal support plates, 22 and 23, respectively. The lower, rearwardly projecting lip of each support plate is provided with a vertical upwardly extending notch 24. As shown in FIGS. 3 and 4, two vertically aligned screws 26 protrude a short distance from the wall 16 and register with respective notches 24 as the invention 11 is readied for final positioning. The frame 12 is then slightly pressed rearwardly against the wall resiliently to compress the projecting lower lip of the support plates 22 and 23 and simultaneously urged downwardly to lodge the shank of each screw 26 in its respective notch 24. The resiliency of the support plates biases the ribs 17 into firm face to face engagement with the wall 16 and securely positions the device in its desired location.

The configuration of the two planar woofer diaphragms 13 and the single, central planar tweeter diaphragm 14 is most clearly illustrated in FIG. 1. While only a portion of the grill cloth 27 has been removed in FIG. 1, the conjugate placement and relative proportions of the three diaphragms are readily apparent. Each woofer diaphragm 13 conveniently measures approximately ten inches wide and thirty eight inches high while the dimensions of the tweeter diaphragm 14 are approximately one and one half inches wide by thirty eight inches high. These diaphragm dimensions result in a total diaphragm radiating surface area of slightly less than six square feet. The standard thickness of each diaphragm panel is ¼" which has been determined to be a satisfactory compromise between the rigidity and weight requirements to practice the present invention.

As will be explained more fully herein, the diaphragms must be sufficiently rigid to avoid flexure oscillations yet light enough to ensure efficient and agile operation. It is also desirable that the diaphragms be constructed from a non-conductive material, since they are positioned in close proximity to magnetic and electro-magnetic fields created by the particular diaphragm drive mechanism employed herein. A product ideally suited to satisfy these weight, composition, and rigidity requirements is sold under the trademark KLEGECELL #33, by the American Klegecell Company. KLEGECELL #33 is a substantially rigid, polyvinylchloride material which is lightweight (2 pounds per cubic foot), non-conductive, and acoustically impermeable.

Having satisfied the design philosophy requirement of engaging a large mass of air, the lightweight planar diaphragms of the present design further assume a particular configuration which makes constructive use of the front and backwave which each planar panel creates. That is to say, the present invention not only uses a multiple planar diaphragm construction, but also supports these diaphragms in a manner and in a spatial co-relation which optimizes their acoustical performance.

A sheet 28, or front mounting plate, constructed of a plastic, or other electrically insulative material, bridges the front or outer edges of the two parallel vertical ribs 17 (see FIGS. 2 and 5) and forms a non-conductive plate upon which both the diaphragms and the plurality of stationary, push-pull drive coils 29 are mounted.

Attached, in turn, to the front or outer surface of the mounting plate 28 are two parallel vertical wooden slats 31 extending the full vertical length of the diaphragms. As can be seen most clearly in FIG. 5, the rear surface of the adjacent vertical marginal portion of each of the woofer diaphragms 13 is secured to the front or outer surface of the respective underlying slat 31. Thus, each woofer diaphragm 13 is edge-secured along its adjacent or proximal extremity 32 to the respective underlying slat 31. Owing to the limited pliancy of the diaphragm material, the remaining free portion of each of the woofer diaphragms 13 is able to pivot within limits about the stationary inner edge in a reciprocating fore and aft motion. Maximum excursion of the woofer diaphragms 13, then, will occur at their respective opposites or distal, or movable, extremities 33 (see FIG. 5).

Figure 5:
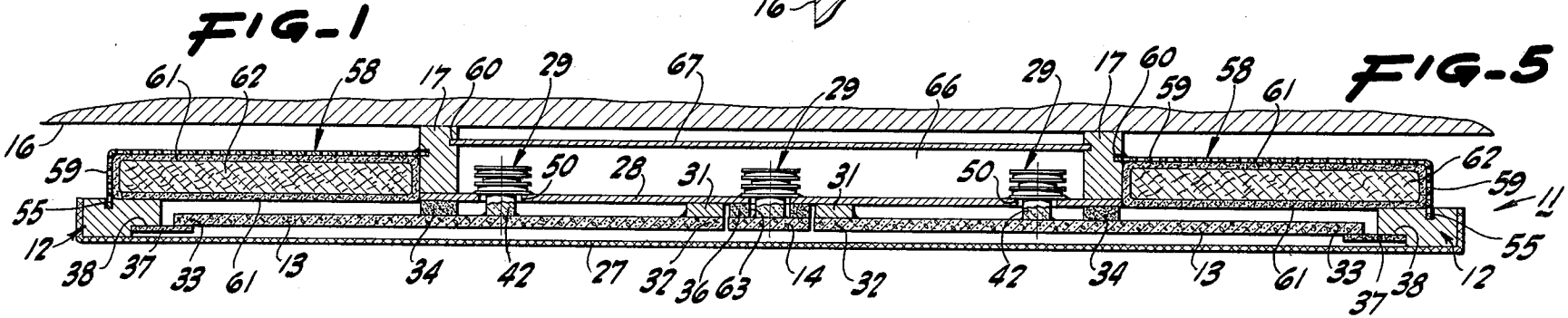
FIG. 5 is a transverse, cross-sectional view, to an enlarged scale, taken on the plane indicated by the line 5—5 in FIG. 1.

Interposed between and attached to the rear, approximate middle portion of each of the woofer diaphragms 13 and the underlying lateral extremities of the mounting plate 28, is a respective vertically elongated foam cushion 34 (see FIGS. 1 and 5). Each cushion 34 extends the entire vertical dimension of the woofer diaphragm 13 and acts as a light buffer or "normalizing spring" for the fore and aft excursions made by the woofers. The nature of this foam cushion is such that each woofer diaphragm 13 is entirely free to make its maximum peak-to-peak excursion of 1/16", or so, at this point, yet a limited resiliency or restorative force is offered as well.

Also mounted upon the plate 28 is the tweeter diaphragm 14. As shown most clearly in FIG. 1, the tweeter diaphragm 14 is also vertically oriented and forms a relatively narrow band positioned between the adjacent lateral ends 32 of the two woofer diaphragms 13. The tweeter diaphragm 14 is attached to the plate 28 with a coextensive foam strip 36. The strip 36 is constructed from an extremely compliant foam material identical to that used for the foam cushion 34. This foam material is capable of maintaining the tweeter diaphragm 14 in operative position, yet is sufficiently compliant to allow unimpeded fore and aft excursions of the tweeter relative to the fixed mounting plate 28. As opposed to the pivoted, or hinged, fore and aft motion of the woofer diaphragms 13, the entire tweeter diaphragm 14 makes linear, or integrated forward and rearward excursions.

A foam surround 37, or border strip, forms a diaphragm periphery, extending along a recessed inner shelf 38 of the frame 12 (see FIGS. 1 and 5). The surround 37 is constructed from a very pliant and acoustically impervious foam material. Diaphragm freedom of movement as well as a reasonably tight acoustical seal between the diaphragms and the frame 12 are thereby afforded.

Figure 6:
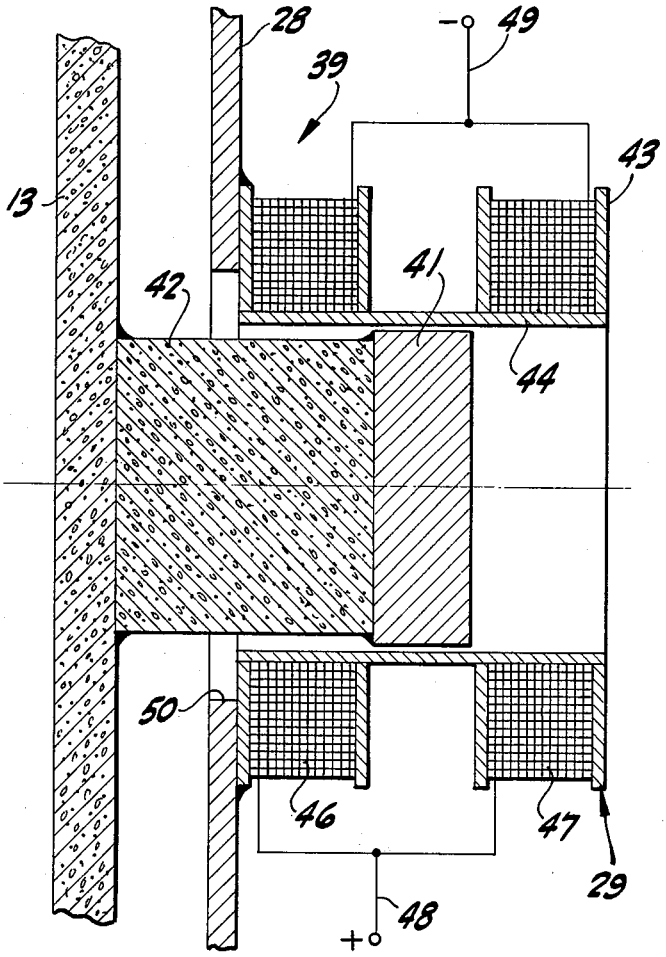
FIG. 6 is a fragmentary sectional view, to a greatly enlarged scale, of a single combined push-pull coil and moving magnet drive assembly of a woofer diaphragm, the non-conductive mounting plate being broken away to show the bore and magnet extension more clearly.

With particular reference to FIG. 6, a combined fixed coil and moving magnet drive assembly 39 is revealed. All of the drive assemblies 39 used to drive the diaphragms 13 and 14 are identical, with four vertically collinear drive assemblies 39 being used for each diaphragm. FIG. 2 most clearly shows the three vertical rows of the drive coils 29 of the combined drive assemblies 39, each lateral row corresponding to one of the woofer diaphragms 13 and the central row corresponding to the tweeter diaphragm 14.

Each drive assembly 39 generally comprises the stationary push-pull drive coils 29, a moving magnet 41, and a magnet extension 42 secured at its after end to the forward surface of the magnet 41 and at its forward end to the back of the woofer diaphragm 13. The coaxially stacked, push-pull drive coils 29 are wound upon an insulative coil form 43, attached to the immobile mounting plate 28. The form 43 includes a hollow, right cylindrical core 44 within which the moving magnet 41 is coaxially positioned for push-pull translation.

The magnet extension 42, constructed from a light yet rigid foam material, performs the dual function of maintaining the magnet 41 in proper position within the core 44 and of transferring the fore and aft motion of the magnet to the diaphragm. The neutral, or "at rest", or centered position for the moving magnet 41 is within the general area between the forward coil 46 and the rearward coil 47. A through bore 50 is provided in the fixed mounting plate 28 for unimpeded travel of the magnet extension 42 as the extension 42 moves in unison with the magnet 41 in response to coil actuation.

The moving magnet 41 is of the recently developed rare-earth, samarium cobalt variety. Providing an extremely high energy product (the product of flux density and magnetizing force) on the order of 20 megagauss oersted, the samarium cobalt magnetic material is sold under the trademark INCOR 20, by the Indiana General Company of Valparaiso, Indiana, and has proved to be an eminently satisfactory material for the moving magnet 41.

Owing to the high energy potential of INCOR 20, a small and therefore lightweight magnet 41 can provide the necessary driving force to obtain the full potential of the present invention. Typically, the magnet 41 would be in the form of a circular disc, 0.525" in diameter, 0.190" in height, and 5.7 grams in weight. The stationary drive coil 29 in combination with the light weight, high energy product moving magnet 41 provides an efficient drive mechanism yet one which adds very little mass to the driven diaphragms.

By significantly reducing the mass of the dynamic driving component in this manner, the moving magnet drive assembly 39 of the preferred embodiment allows the woofer diaphragms 13 and the tweeter diaphragm 14 to be more acoustically loaded, than mass loaded. That is to say, the mechanical resistance of the driven air, as opposed to the mass of the bulky moving coil drive mechanism of conventional design, forms a considerable component of the overall electrical resistance which the system presents to the power source. In short, the high energy moving magnet drive mechanism is ideally matched to fulfill the design philosophy of an acoustically loaded, electro-acoustic transducer.

Interposed between the forward coil 46 and the rearward coil 47, the moving magnet 41 is subjected to the complementary push-pull magnetic forces which the coils create. The resultant fore and aft motion of the magnet 41 is transferred directly through the rigid extension 42 to the forward positioned diaphragms. The moving magnet's maximum excursion is approximately 1/32", or 1/16" peak-to-peak, ensuring adequate coupling with both coils 46 and 47 throughout normal operating range.

Having discussed the combined fixed coil and moving magnet drive assembly 39 in structural and operational aspects, the interconnections between the individual push-pull drive coils 29 and the crossover network circuitry 54 will now be described.

FIG. 6 illustrates the physical layout of the interconnected push-pull drive coils 29, including a "positive" input leg 48 and a "negative" input leg 49.

Figure 7:
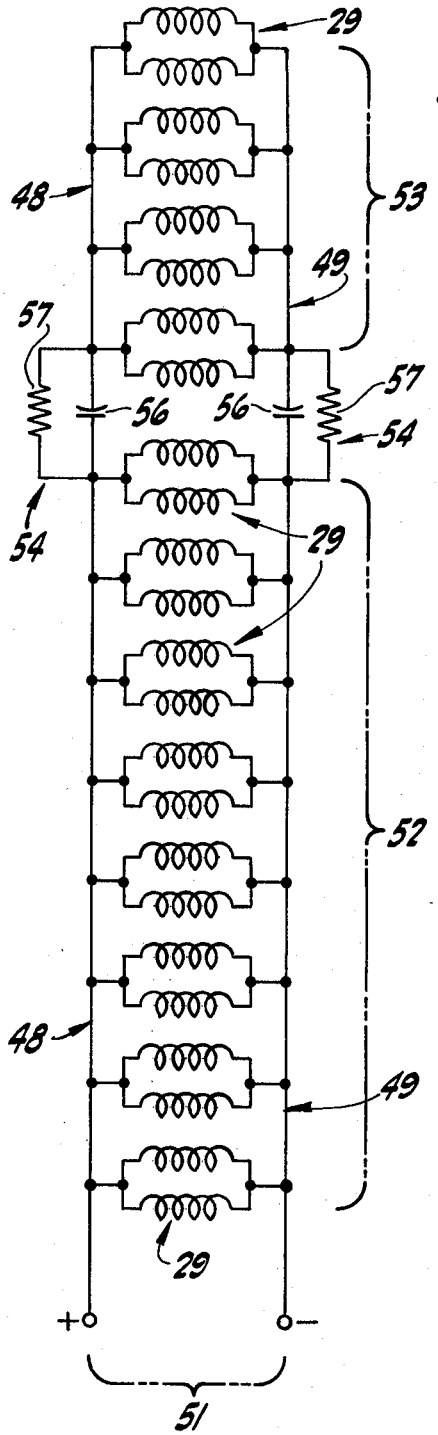
FIG. 7 is a schematic representation of the crossover network circuitry and interconnected array of woofer and tweeter push-pull drive coils.

With reference to circuit diagram FIG. 7, the parallel interconnections between the plurality of drive coils 29 shunting the legs 48 and 49 are shown in schematic fashion. Given a characteristic impedance of approximately 5 ohms per individual coil 46 or 47, the resultant load presented with all the coils 29 connected in parallel is considerably less than one ohm. With all of the coils so connected, the inductive reactance is similarly reduced to a very low ohmic value.

The power source, or signal, is fed directly across the transducer input terminals 51, thereby providing the woofer coil assembly 52 with the full range of audio frequencies. The tweeter coil assembly 53, however, is fed in parallel by crossover network circuitry comprising two crossover legs 54.

Each crossover leg 54 includes a 16 mfd capacitor 56 in parallel with a 6 ohm 55 watt resistor 57. The capacitor 56 provides a 6 db per octave attenuation frequencies below 5 kilohertz to ensure that the tweeter coil assembly 53 substantially receives the range of audio frequencies which it can reproduce faithfully. Since the capacitor 56 induces a phase shift of 90° between the signal's voltage and current components, the resistor 57 is included in order to "bleed over" a portion of the signal to the tweeter coil assembly 53. In this manner, the tweeter diaphragm is "set up" for the incoming signal and phase shift discontinuities between the woofer and tweeter diaphragm responses are minimized.

It should also be noted that while all of the drive coils 29 are shown interconnected in a parallel configuration, a series-parallel configuration may be desirable in some instances to raise the characteristic impedance which the power source "sees", effecting a better source to load match. Since proper performance of the woofer diaphragms 13 requires that they be driven in phase, a series-parallel configuration would require that the interconnections among the four coils 29 driving each woofer diaphragm 13 be identical.

In the preferred embodiments of the invention, all of the woofer and tweeter push-pull drive coils 29 are connected in parallel, and therefore the respective diaphragms 13 and 14 are driven in phase. That is to say, considering the woofer diaphragms 13 in the first instance, the two planar diaphragms 13 pivot, or hingeably move, or swing, about their respective, frame attached, adjacent extremities 32 in synchronous fore and aft fashion. As previously explained, although the material from which the diaphragms 13 are constructed in substantially rigid, the ¼" thick diaphragms do exhibit sufficient pliancy to permit the required diaphragm excursion. It should be noted, however, that if the diaphragm material were too pliant, unwanted flexure oscillations would create distorted wave fronts.

The diaphragms 13 are driven at a point slightly less than midway between their respective proximal and distal extremities 32 and 33, as shown in FIG. 5. It will be appreciated that the proper driving point for the woofer diaphragms from their attached proximal extremity 32 will depend upon a number of variables, namely, the mass of the diaphragm 13, the energy product of the magnet 41, the configuration of the driving coil 29, and the calculus for determining the optimum excursion and velocity for a given diaphragm size and material. As the driving point is moved closer to the diaphragm's attached proximal extremity 32, an increase in diaphragm excursion and velocity should be experienced. Beyond a certain point, however, the "effective" levered mass of the woofer diaphragm 13 will overtax the capabilities of the drive mechanism to respond accurately to the input waveform. If the driving point were moved closer to the diaphragm's movable, or distal extremity 33, the dynamic response of the diaphragm would be improved; but the lack of adequate diaphragm excursion may result in an unusable sound pressure level. Therefore, taking into consideration the relevant variables, a satisfactory compromise between dynamic and amplitude responses can readily be reached by one skilled in the art.

With the two woofer diaphragms 13 driven forwardly in phase, two frontal waves are produced which interfere constructively in the listener's area in front of the speaker. The nature of the frontal wave produced by each diaphragm 13 is such that the wave amplitude decreases from the movable, distal extremity 33 to the attached, proximal extremity 32. Nonetheless, since the planar diaphragms themselves are substantially rigid and remain substantially planar as they pivot, the phase relationship of the resultant wavefront is maintained regardless of the frequency or amplitude of the incoming drive signal. The constructive interference of the two in-phase, frontal waves, in order words, produces an augmented amplitude response which is independent of variations in the drive signals's frequency or amplitude.

It should be noted that while the front mounting plate 28 is preferably constructed from an acoustically impermeable material, such as wood or plastic its position relative to the diaphragms 13 assures that as the diaphragms 13 reverse direction and travel rearwardly, no significant acoustic reactance is thereby introduced. Owing to the pivoted configuration of the woofer diaphragms 13, the extent of the excursion of the diaphragms 13 between the foam cushion 34 and the fixed proximal extremity 32 is relatively small. In other words, the amplitude of the backwave generated in this region is weak, and its inability to vent through the plate 28 does not adversely load the diaphragms 13.

In the region between the foam cushion 34 and the distal movable extremity 33, however, the amount of the excursion and the velocity of the diaphragms 13 increase considerably. The acoustic slot 18, previously described, serves to vent, primarily laterally, the backwave produced by the more extensive rearward excursions of the woofer diaphragms 13. While the slot 18 extends completely around the frame 12, the lateral portions of the slot 18 pass the bulk of the backwave owing to the manner in which the backwave is generated. As with the frontal wave, the amplitude peak of the backwave is found along the lateral distal extremities 33 of the diaphragms 13. The backwave readily vents, then, through the subjacent lateral portions of the slot 18.

An acoustically absorptive cell 58, comprises a perforated cage 59, two spaced layers of DACRON 61, and a single filler layer of FIBERGLASS 62. As is best shown in FIG. 5, the cage 59 supports and contains the DACRON 61 which surrounds the FIBERGLASS 62. The cage 59 is glued or epoxied into the respective shallow grooves 55 and 60 in the frame 12 and the ribs 17.

It is well known in the art that DACRON material is effective in absorbing the mid and low-midrange frequencies, while fiberglass material is equally well suited for absorbing low range audio frequencies. In the range of frequencies which the woofers are designed to reproduce, namely, from 20 Hz to 5 KHz, the cell 58 including the triple layer of DACRON-FIBERGLASS-DACRON serves to reduce the amplitude of the backwave by approximately 10 decibels.

The attenuated backwave generated by both of the woofer diaphragms 13 will vent laterally along the slot 18, or channel, adjacent the wall 16, upon which the device is mounted. The backwave thus does not reflect off the rear positioned wall 16 to impinge destructively upon the diaphragm as with prior art planar transducers which may be similarly positioned near a rear wall. Rather, the backwave is directed to cooperate acoustically with the wall 16 to enhance the dispersion and amplitude of audio frequencies below 5 KHz produced by the diaphragms 13. And, since the diaphragms 13 are so close to the wall 16, the frontal wave and the laterally vented backwave will reach the listener in nearly perfect phase relationship.

Turning now to the operation of the tweeter diaphragm 14, the narrow vertical diaphragm is placed into front and rear motion by the middle, vertical row of four push-pull drive coils 29 and the respective high energy moving magnets 41. A small, circular cutout 63, as is best shown in FIG. 5, is provided to pass each of the magnet extensions 42 through the foam strip 36. Owing to the extreme compliancy of the foam strip 36, the low mass tweeter diaphragm 14 is free to make its rapid, but relatively short, front and rear excursions for optimum acoustic response.

A plurality of vertically aligned relief ports 64 (see FIG. 2) is provided in the front plate 28 to allow the high frequency backwave, produced by the rearward thrust of the tweeter diaphragm 14 against the foam strip 36, to pass into a chamber 66 defined by a rear plate 67 which extends across and joins the after side portions of the ribs 17. By allowing the relatively small amplitude backwave of the tweeter diaphragm 14 to exit freely through the relief ports 64 into the chamber 66, the tweeter is provided with a backwave release while being protected from the woofer backwave.

As an alternative embodiment, in a more simplified configuration, a single woofer planar diaphragm in combination with a single tweeter planar diaphragm is shown and briefly explained herein. Since the structural details and operation of this alternative embodiment are nearly identical to that of thepreferred embodiment, the differences rather than the apparent similarities will be emphasized.

The reference numerals used to identify particular structural elements of the alternative embodiment will be identical to those used in describing the identical or similar elements in the embodiment previously described, but with the numeral 1 as a prefix.

Figure 9:
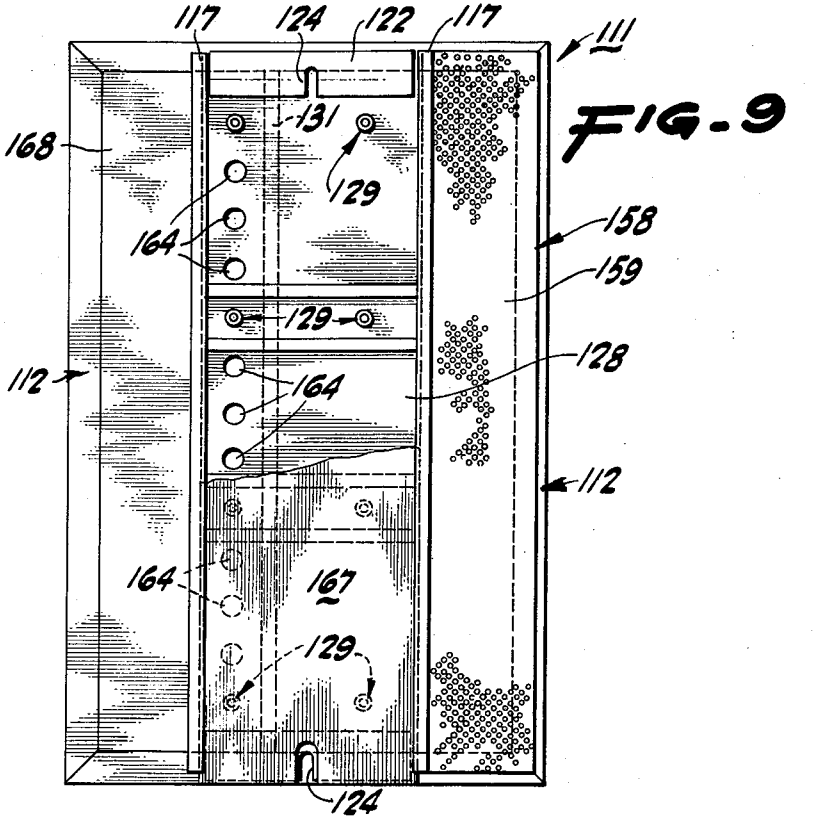
FIG. 9 is a rear elevational view of the embodiment of FIG. 8.
Figure 8:
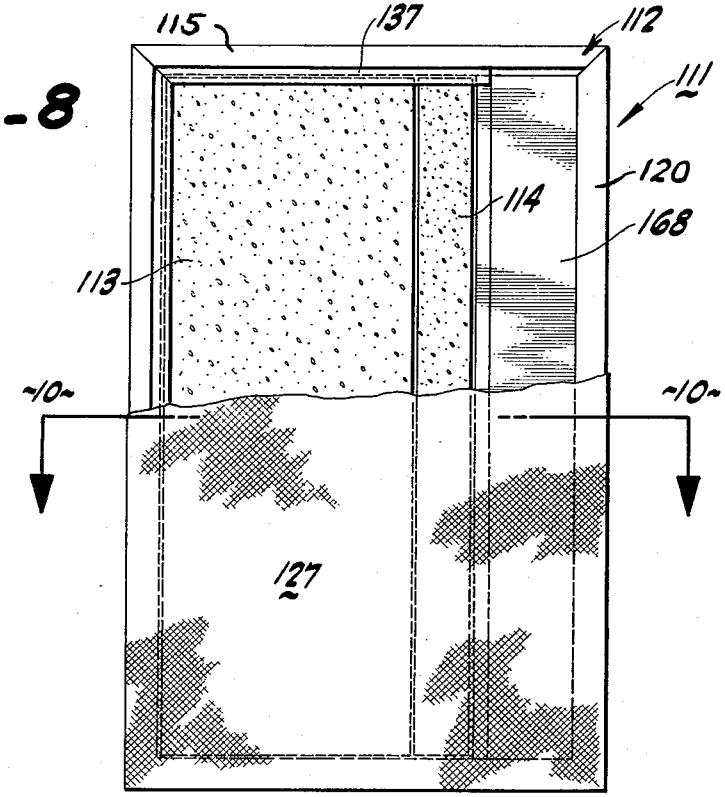
FIG. 8 is a front elevational view of an alternative preferred embodiment of the invention with a portion of the grill cloth broken away to reveal the single woofer and the single tweeter planar diaphragms.
Figure 10:
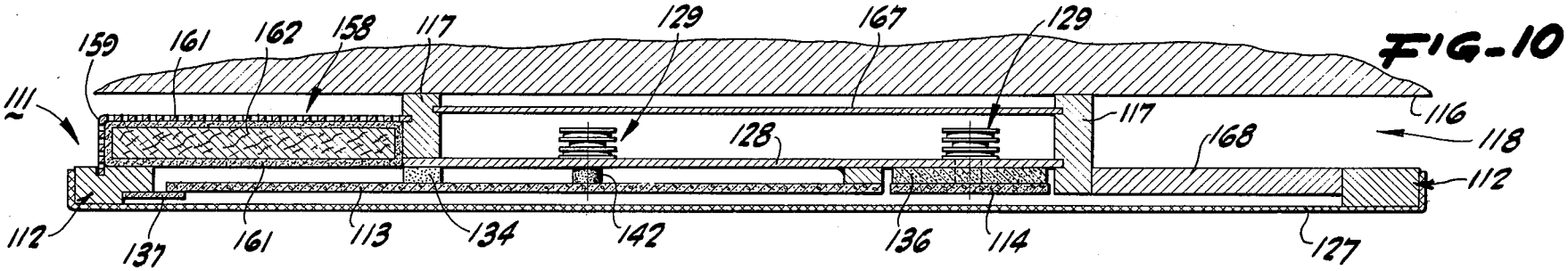
FIG. 10 is a cross sectional view, to an enlarged scale, taken on the plane indicated by the line 10—10 in FIG. 8.

Turning, then, to FIGS. 8, 9 and 10, the alternative preferred embodiment 111 of the invention is illustrated. The embodiment 111 is chiefly distinguishable in having but a single planar woofer diaphragm 113. In FIG. 8, a "left hand" speaker is shown. A "right hand" speaker, not shown, is substantially a mirror image thereof. From the listener's front reference point of view, in other words, the right hand speaker would have its woofer diaphragm 113 on the far right and its tweeter diaphragm 114 positioned adjacent the tweeter diaphragm 114 of the left hand speaker. Owing to the unique mode of woofer cooperation, as will now be explained, the alternative embodiment 111 is chiefly designed for dual speaker, or stereophonic operation.

Since there is generally little channel separation in low frequency stereo program material, the woofer drive coils 129 in the left hand and right hand speakers will be fed substantially the same signal to be reproduced. In a manner analogous to the frontal wave cooperation between the mirror twin woofer diaphragms 13 in the FIGS. 1–7 form of device, the woofer diaphragms 113 in a left hand and right hand stereo configuration of the alternative embodiment 111, cooperate acoustically. That is to say, the lower frequency frontal waves produced by the woofer diaphragms in the left hand and the right hand speakers will constructively interfere to a considerable extent as the in phase frontal waves reach the listener.

The tweeter 114 in the alternative preferred embodiment 111 is offset from the central vertical longitudinal axis of the frame 112, as can best be seen in FIGS. 8 and 10. To minimize unwanted reflections of high frequency wave fronts, a planar spacer 168 is interposed between the rib 117 adjacent the tweeter 114, and the adjacent sidepiece 120 of the frame 112. The spacer 168 establishes a fixed distance of approximately four inches to five inches from the closest edge of the tweeter diaphragm 114 to the adjacent sidepiece 120. At the frequencies which the tweeter is designed to reproduce, from 5 KHz to beyond 20 KHz, this distance is sufficient to isolate the tweeter from the potentially harmful acoustical effects of the frame 112.

In all other material respects of construction and operation, the alternative embodiment 111 is identical to that of the preferred embodiment.

While the preferred embodiments of the invention 11 use rectangular planar diaphragms 13 and 14, a number of other shapes and configurations will be apparent to one skilled in the art. For instance, the planar diaphragms could be made in the form of squares, triangles, circles, or other geometric forms without deviating from the spirit of the invention. Also, additional planar diaphragms could be included in alternative embodiments. For example, top and bottom woofer diaphragms could easily supplement the lateral woofer diaphragms of the preferred embodiment. Hexagonal or octagonal arrays of planar diaphragms are similarly envisioned as possible variant arrangements.

It can therefore be seen that I have provided an electro-acoustic transducer which provides the numerous advantages of the planar variety yet circumvents or minimizes the disadvantages thereof.

I claim:

1. An electro acoustic planar transducer comprising:

a. a substantially planar frame having a front side and a rear side;

b. means for mounting said frame on a vertical planar surface so that said front side faces away from the planar surface;

c. a planar, rectangular, woofer diaphragm, the long dimension of said woofer diaphragm being in vertical attitude, said woofer diaphragm having a vertical proximal edge and an opposite vertical distal edge;

d. means for mounting said woofer diaphragm on and parallel to said frame for alternating movement toward and away from said front side and said rear side, said proximal edge being mounted on said frame and said distal edge being movable;

e. first cooperating coil and magnet means, interposed between said frame and said woofer diaphragm, for driving said woofer diaphragm in response to an electrical signal impressed upon said first coil means, said distal edge partaking in excursions as said woofer diaphragm is driven;

f. sound absorptive means mounted on said frame and interposed between at least one predetermined portion of said woofer diaphragm and said planar surface for attenuating the acoustic back waves generated by said predetermined portion of said woofer diaphragm;

g. a planar tweeter diaphragm;

h. means for mounting said tweeter diaphragm on and parallel to said frame for alternating movement toward and away from said front side and said rear side; and, i. second cooperating coil and magnet means interposed between said frame and said tweeter diaphragm for driving said tweeter diaphragm in response to said electrical signal impressed upon said second coil means.

2. A transducer as in claim 1 in which said predetermined portion of said woofer is located in the vicinity of said opposite, vertical distal edge where maximum excursions occur.

3. A transducer as in claim 2 further including an elongated highly compliant foam cushion interposed between and mounted vertically on said frame and said woofer diaphragm intermediate said vertical edges thereof.

4. A transducer as in claim 3 further including a vertical highly compliant foam strip interposed between and mounted on said planar tweeter diaphragm and said frame.

5. A transducer as in claim 4 in which said frame comprises a vertically elongated "picture frame" including horizontal top and bottom rails and a pair of vertical sidepieces; a pair of parallel vertical ribs extending between said top and bottom rails; a rigid front plate mounted on the front surface of said ribs; a rigid rear plate spanning said ribs parallel to and spaced from said front plate to define with said front plate and said ribs an acoustic chamber; and a perforate cage enclosing said sound absorptive means, said cage being spaced from the adjacent wall to form an acoustic aperture therebetween.

6. A transducer as in claim 5 including a pair of parallel vertical slats mounted on the front surface of said front plate, said one vertical edge of each of said planar woofer diaphragms being mounted on the respective one of said slats.

7. A transducer as in claim 6 further including a highly compliant foam surround mounted on said frame and encompassing the peripheral margin of said woofer and said tweeter diaphragms combined.

8. An electro-acoustical transducer for use on a planar surface comprising:

a. A pair of lightweight, substantially rigid, planar, woofer diaphragms;

b. lightweight substantially rigid, planar, tweeter diaphragm;

c. a frame having a front side and a rear side, said rear side facing toward the planar surface;

d. means for mounting said woofer diaphragms and said tweeter diaphragm on said frame in co-planar relation a predetermined distance from the planar surface of predetermined width to form a channel around the periphery of said diaphragms, said woofer diaphragms being attached to said frame at their adjacent proximal edges allowing unimpeded front and rear motion of their respective distal edges; and, e. electro-mechanical drive means mounted on said frame and interconnected to said woofer diaphragms a predetermined distance from said adjacent proximal edges of said woofer diaphragms for placing said woofer diaphragms into front and rear motion about their respective proximal edges in response to an electrical drive signal, said drive means being further interconnected to said tweeter diaphragm for placing said tweeter diaphragm into front and rear motion in accordance with a supplied electrical drive signal.

9. A transducer as in claim 8 including a pair of pieces of highly compliant material interposed between and attached to said frame and said woofer diaphragms and a piece of highly compliant material interposed between and attached to said frame and said tweeter diaphragm, said material being yieldable to permit fore and aft motion of said diaphragms relative to said frame.

10. A transducer as in claim 8 in which said peripheral channel underlies the distal edge portion of each of said woofer diaphragms and acoustically vents the backwaves generated thereby in a lateral direction, the intent of said predetermined channel width being selected so that the laterally vented backwave and the frontal wave generated by said woofer diaphragm advance in substantially perfect phase relationship.

11. A transducer as in claim 10 including an acoustically absorptive cell mounted on said frame and interposed between said distal edge portion of each of said woofer diaphragms and the underlying portion of said peripheral channel to reduce the amplitude of the backwave generated by said woofer diaphragm.

12. A transducer as in claim 11 in which said cell includes layers of DACRON and FIBERGLASS, and a perforated cage encompassing the after side of said cell.

* * * * *